US008322635B2

(12) United States Patent
Choi

(10) Patent No.: US 8,322,635 B2
(45) Date of Patent: Dec. 4, 2012

(54) INJECTOR FOR ENGINE

(75) Inventor: Changyeol Choi, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 160 days.

(21) Appl. No.: 12/939,806

(22) Filed: Nov. 4, 2010

(65) Prior Publication Data

US 2012/0048970 A1 Mar. 1, 2012

(30) Foreign Application Priority Data

Aug. 27, 2010 (KR) ..... 10-2010-0083394

(51) Int. Cl.

| | |
|---|---|
| ***F02M 61/10*** | (2006.01) |
| ***F02M 61/04*** | (2006.01) |
| ***F02M 61/00*** | (2006.01) |
| ***B05B 1/30*** | (2006.01) |

(52) U.S. Cl. ..... 239/533.2; 239/581.1; 239/584

(58) Field of Classification Search ..... 239/95, 239/225.1, 246, 249, 263.1, 533.2, 581.1, 239/584

See application file for complete search history.

(56) References Cited

U.S. PATENT DOCUMENTS

| | | | | |
|---|---|---|---|---|
| 5,645,225 | A * | 7/1997 | Hasegawa et al. | 239/533.12 |
| 5,947,389 | A * | 9/1999 | Hasegawa et al. | 239/533.2 |
| 5,975,433 | A * | 11/1999 | Hasegawa et al. | 239/533.12 |
| 5,979,802 | A * | 11/1999 | Hasegawa | 239/533.12 |
| 6,055,957 | A * | 5/2000 | Hasegawa et al. | 123/305 |
| 6,206,304 | B1 * | 3/2001 | Koseki et al. | 239/533.12 |

FOREIGN PATENT DOCUMENTS

| | | | |
|---|---|---|---|
| JP | 11-44278 | A | 2/1999 |
| JP | 2000-73914 | A | 3/2000 |
| JP | 2004-27955 | A | 1/2004 |
| JP | 2004-150398 | A | 5/2004 |
| JP | 2008-101493 | A | 5/2008 |
| JP | 2008-196363 | A | 8/2008 |
| JP | 2009-257216 | A | 11/2009 |
| KR | 2000-0068946 | A | 11/2000 |

* cited by examiner

*Primary Examiner* — Darren W Gorman

(74) *Attorney, Agent, or Firm* — Morgan, Lewis & Bockius LLP

(57) ABSTRACT

An injector apparatus for an engine, may include an injector body, an actuator mounted in the injection body, a rotary rod rotatably received in the injector body and selectively rotated by the actuator, wherein a fuel groove may be formed on outer surface of the rotary rod along a longitudinal direction thereof, and a nozzle hole formed at a nozzle of the injector body to selectively communicate with the fuel groove in accordance with rotation of the rotary rod, wherein the rotary rod slidably contacts with the nozzle in the injector body.

5 Claims, 7 Drawing Sheets

<UNDER PARTIAL LOAD> <UNDER ENTIRE LOAD>

<UNDER PARTIAL LOAD> <UNDER ENTIRE LOAD>

INJECTOR FOR ENGINE

CROSS-REFERENCE TO RELATED APPLICATIONS

The present application claims priority to Korean Patent Application Number 10-2010-0083394 filed Aug. 27, 2010, the entire contents of which application is incorporated herein for all purposes by this reference.

BACKGROUND OF THE INVENTION

1. Field of the Invention

The present invention relates to an injector for an engine, and more particularly, to the structure of an electronically controlled injector that can appropriately inject fuel in accordance with the operational conditions of the engine by changing the fuel injection types in various ways.

2. Description of Related Art

Electronically controlled injectors of the related art have a solenoid valve in the body and inject fuel by electrically controlling the solenoid valve to operate a needle and open a nozzle hole.

As the difference in diameter at the inlet and the outlet of the nozzle hole changes, the injection type of fuel injected through the nozzle hole changes, and the injection type of fuel can be divided into a type that is advantageous in improving the output of the engine and a type that is advantageous in reducing harmful exhaust gas.

That is, when the diameter of the nozzle hole is smaller at the inlet than the outlet, cavitation occurs due to the fuel passing through the nozzle hole and fuel injection that is advantageous in mixing the fuel with air is implemented, such that it is advantageous in reducing fuel consumption and harmful exhaust gas. Further, when the diameter of the nozzle hole is larger at the inlet than the outlet, the fuel is injected without causing the cavitation, such that a larger amount of fuel can be injected and fuel injection that is advantageous for output of the engine.

However, the nozzle holes of the related art is formed in a predetermined shape at the lower end of injectors, such that they cannot changes the types of fuel injection appropriately in accordance with the operational conditions of the engine, as described above.

Further, the injector equipped with a solenoid valve, as described above, cannot achieve injection rate shaping, as compared in FIG. 1.

That is, the solid line in the graph of FIG. 1 show changes in the injection amount to time in the injector equipped with a solenoid valve of the related art, in which the shape is simple and other dotted lines in the graph show various injection types and is difficult to be implemented by the injector equipped with a solenoid valve of the related art.

Piezo injectors equipped with a piezo element have been used in the related art to variably implement the various injection types shown by the other dotted lines, not the solid line in FIG. 1, but the cost is high.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an injector for an engine that controls whether to make cavitation when fuel passes through the nozzle hole, implements various types of fuel injection for increasing output of the engine or reducing fuel consumption and harmful exhaust gas in accordance with the operational conditions of the engine by changing the shape of the nozzle hole injecting the fuel and to provide an injector for an engine that can achieve injection rate shaping at a low cost without using an expensive piezo element.

In an aspect of the injector apparatus for an engine, may include an injector body, an actuator mounted in the injection body, a rotary rod rotatably received in the injector body and selectively rotated by the actuator, wherein a fuel groove may be formed on outer surface of the rotary rod along a longitudinal direction thereof, and a nozzle hole formed at a nozzle of the injector body to selectively communicate with the fuel groove in accordance with rotation of the rotary rod, wherein the rotary rod slidably contacts with the nozzle in the injector body.

The actuator may be a step motor.

A plurality of the nozzle holes may be circumferentially disposed on the nozzle in a rotational direction of the rotary rod, wherein two adjacent nozzle holes in the nozzle may have different diameters at an inlet and an outlet respectively.

One of the two adjacent nozzle holes may have a diameter larger at the inlet than the outlet thereof, and the other may have a diameter smaller at the inlet than the outlet thereof.

Even number of nozzle holes may be provided and one fuel groove of the rotary rod may be selectively disposed between the two adjacent nozzle holes.

Injection rate may be controlled by operating the actuator while changing a rotational speed and a position thereof.

In another aspect of the present invention, the injector apparatus for an engine, may include an injector body having a nozzle at a lower end thereof, wherein the nozzle may include a nozzle hole, a step motor installed in the injector body, and a rotary rod selectively rotated by the step motor and having a fuel groove longitudinally formed on outer surface thereof, wherein fluid communication of the nozzle hole with the fuel groove may be selectively changed by rotation of the rotary rod.

A slope may be formed at a lower end of the rotary rod, and the nozzle hole may be formed at corresponding portion of the nozzle which may be slidably in contact with the slope, wherein a plurality of nozzle holes may be formed at the nozzle a rotational direction of the rotary rod.

Even number of nozzle holes may be provided and one fuel groove of the rotary rod may be selectively disposed between the two adjacent nozzle holes.

Two adjacent nozzle holes in the nozzle holes may have different diameter at an inlet and at an outlet respectively.

One of the two adjacent nozzle holes may have a diameter larger at the inlet than the outlet thereof, and the other may have a diameter smaller at the inlet than the outlet thereof.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
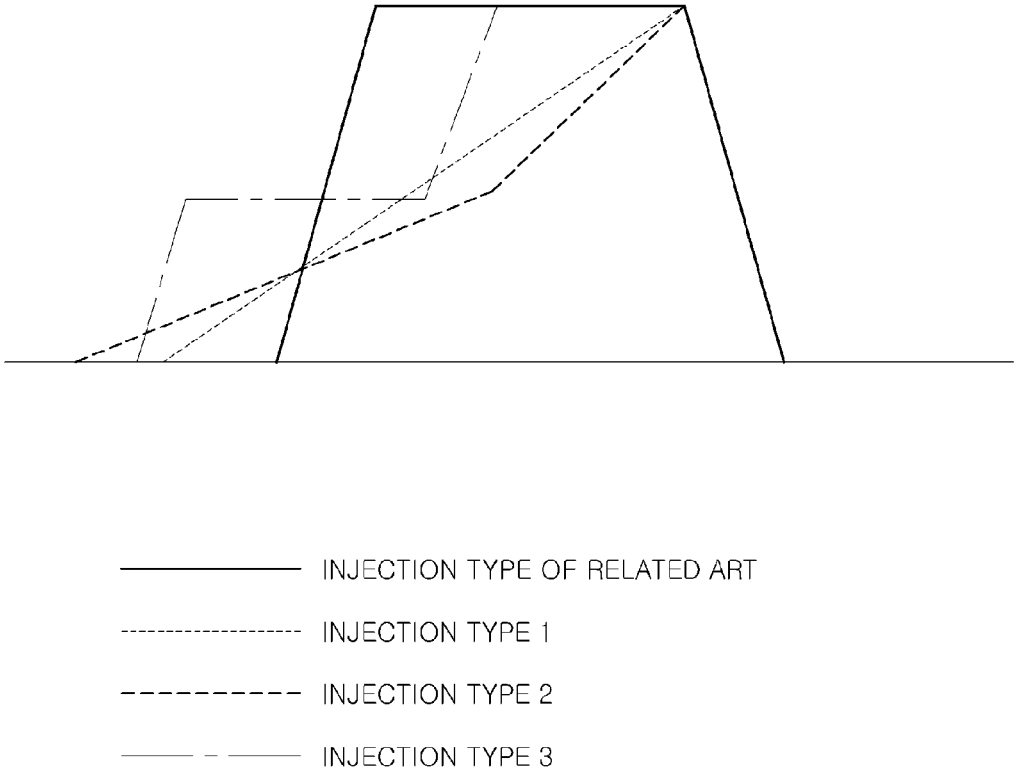
FIG. 1 is a graph showing changes in the injection amount to time in an injector.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
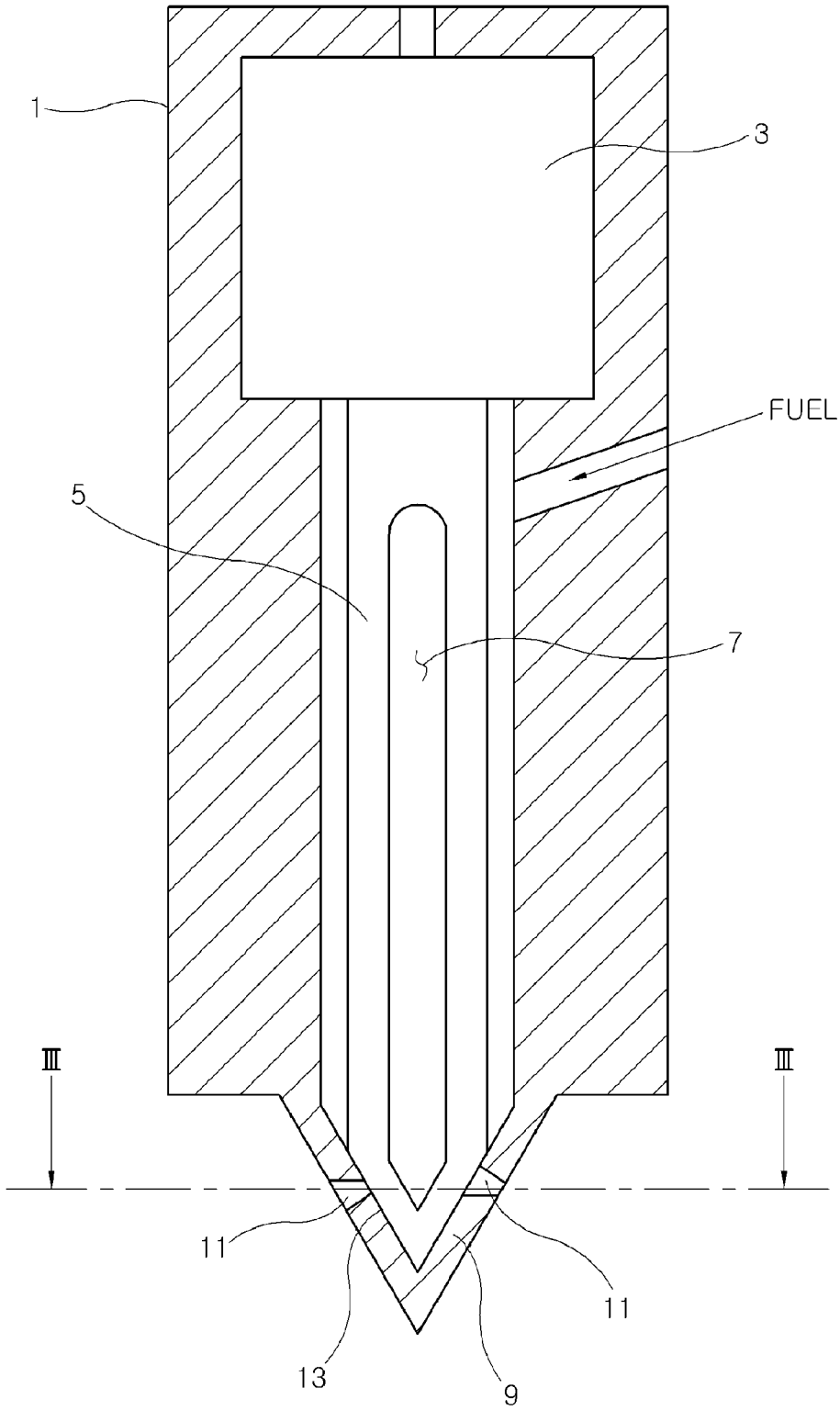
FIG. 2 is a view showing the configuration of an injector for an engine according to an exemplary embodiment of the present invention.
Figure 3:
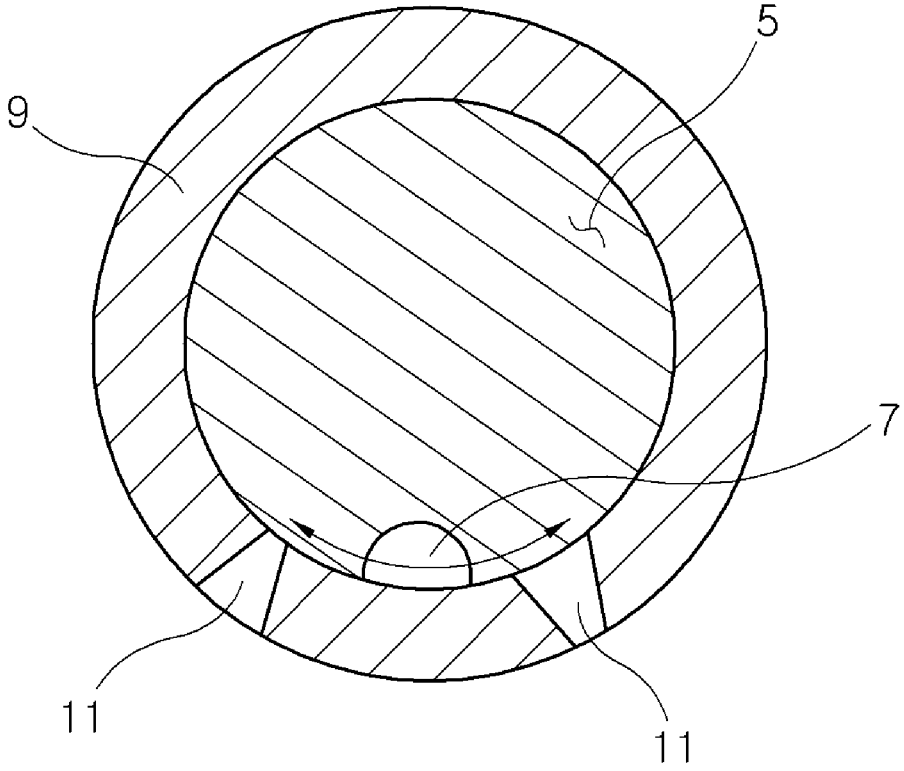
FIG. 3 is a cross-sectional view taken along the line III-III of FIG. 2.

Referring to FIGS. 2 and 3, an injector according to an exemplary embodiment of the present invention includes an injector body 1, an electric motor 3 mounted in injector body 1, a rotary rod 5 rotated by electric motor 3 in injector body 1, a fuel groove 7 formed on the surface of rotary rod 5, and a nozzle hole 11 formed at a nozzle 9 of injector body 1 to communicate with fuel groove 7 while rotary rod 5 rotates.

That is, common injectors of the related art control fuel injection by longitudinally moving a needle, which corresponds to rotary rod 5, to open nozzle hole 11, whereas in an exemplary embodiment of the present invention the electric motor operates while changing the rotational speed or position, such that nozzle hole 11 is opened by rotation of rotary rod 5 and the injection rate of fuel can be controlled.

Nozzle 9 is formed at the lower end of injector body 1, fuel groove 7 is longitudinally formed on the surface of rotary rod 5, a slope 13 is formed at the front end of rotary rod 5, and nozzle hole 11 is formed at the portion of nozzle 9 which is in close contact with slope 13 at the front end of rotary rod 5.

Electric motor 3 is a step motor and a plurality of nozzle holes 11 is disposed circumferentially in the rotational direction of rotary rod 5.

Therefore, which nozzle hole 11 in nozzle holes 11 is opened and how much the nozzle hole 11 is opened are determined in accordance with a rotational angle of rotary rod 5 by accurately and rapidly controlling the step motor, which allows for accurate control of fuel injection.

Two adjacent nozzle holes 11, which have a difference in diameter at the inlets and the outlets, in nozzle holes 11 are disposed in this embodiment.

In particular, as shown in FIG. 3, any one of adjacent two nozzle holes 11 has a diameter larger at the inlet than the outlet and the other has a diameter smaller at the inlet than the outlet.

Figure 4:
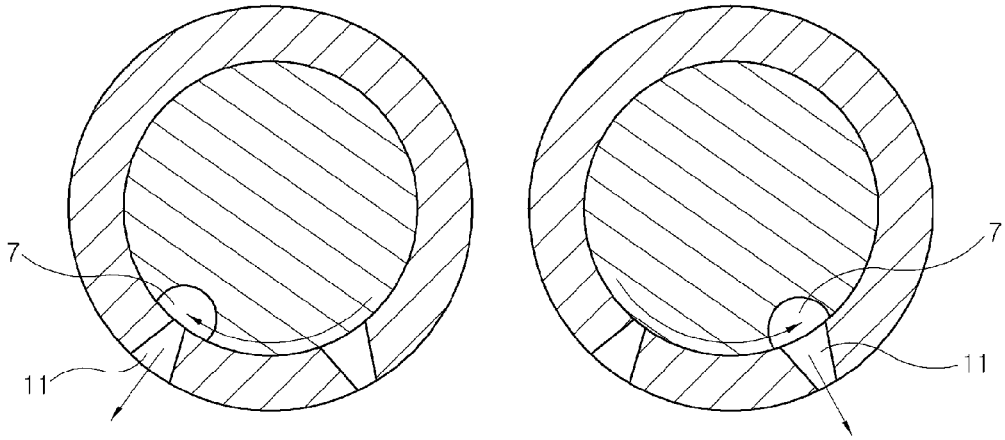
FIG. 4 is a view illustrating the operation of the injector of FIGS. 2 and 3.

Therefore, as compared in FIG. 4, as electric motor 3 rotates rotary rod 5 and fuel groove 7 communicates with nozzle hole 11 having a diameter smaller at the inlet than the outlet, as shown at the left in the figure, fuel injection that is advantageous in mixing fuel with air is implemented by cavitation in fuel injection, such that the type of fuel injection that is advantageous in reducing fuel consumption and harmful exhaust gas.

On the contrary, as fuel groove 7 of rotary rod 5 communicates with nozzle hole 11 having a larger diameter at the inlet than the outlet, as shown at the right side in the figure, the fuel is injected without causing cavitation, such that the type of fuel injection that is advantageous in improving the output performance of the engine is implemented.

Therefore, a controller controlling electric motor 3 determines and rotates rotary rod 5 in accordance with operational conditions of the engine, such that the type of fuel injection that is more suitable for the operation conditions of the engine can be implemented.

Even number of nozzle holes 11 may be provided and one fuel groove 7 of rotary rod 5 is disposed between adjacent two nozzle holes 11. For reference, although only two nozzle holes 11 and one fuel groove 7 are shown in FIGS. 3 and 4, a plurality of sets of nozzle holes 11 and fuel grooves 7 may be disposed along the circumference of nozzle 9 and rotary rod 5. However, one set is representatively shown to prevent confusion.

Figure 5:
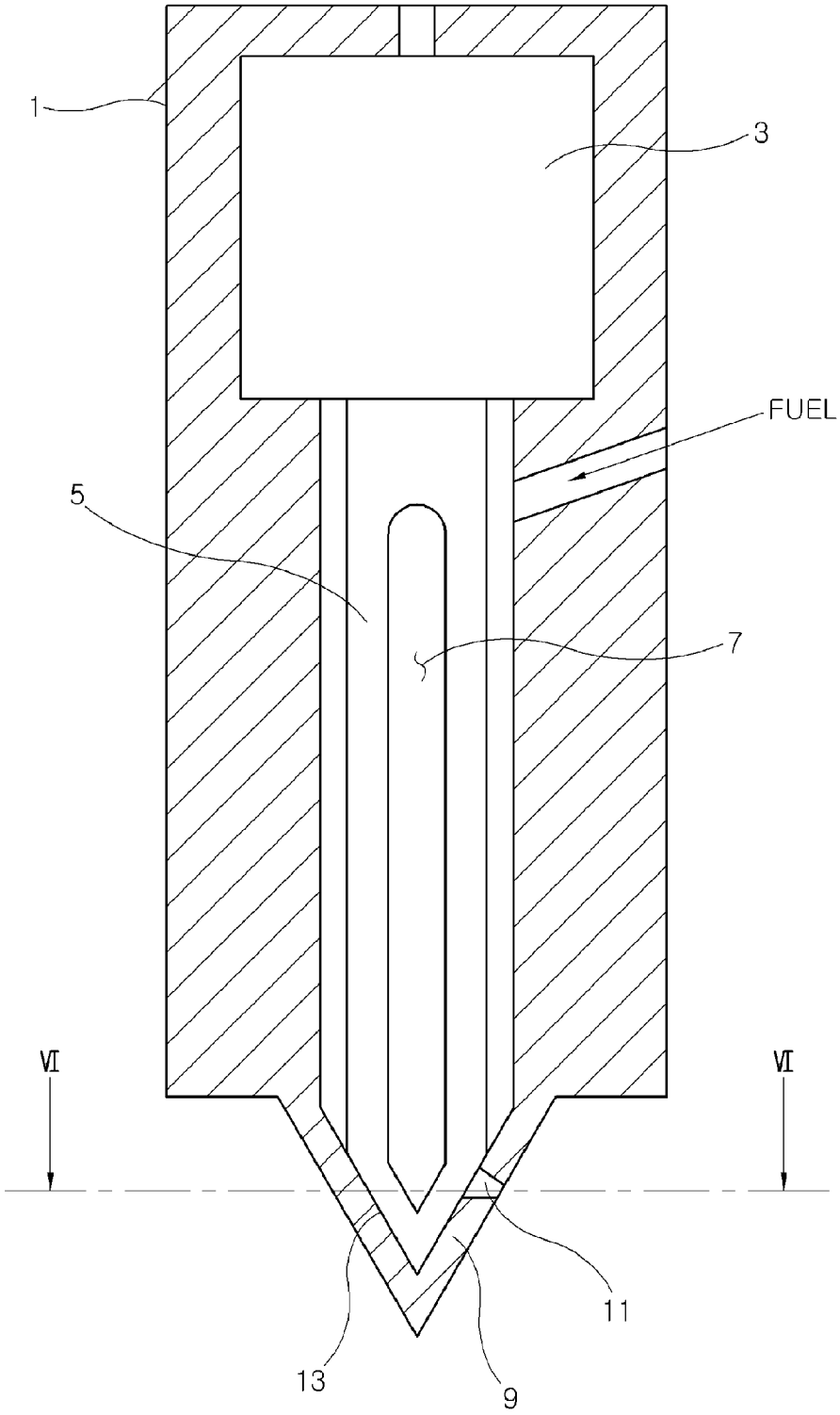
FIG. 5 is a view showing the injector for an engine according to an exemplary embodiment of the present invention.
Figure 6:
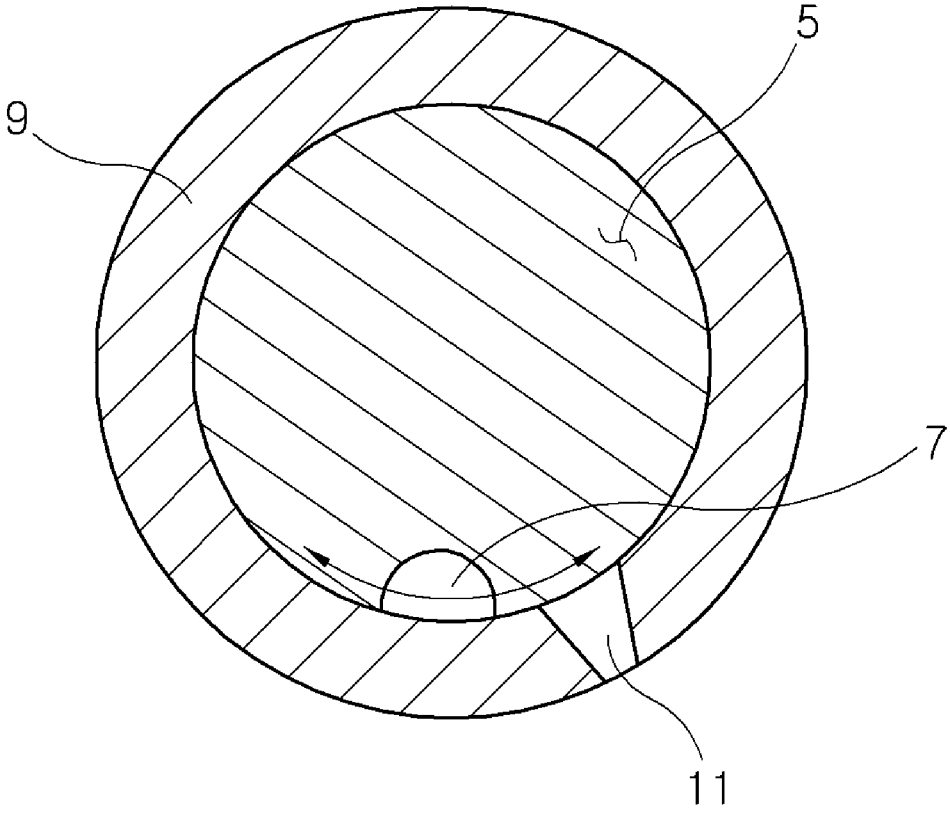
FIG. 6 is a cross-sectional view taken along the line VI-VI of FIG. 5.
Figure 7:
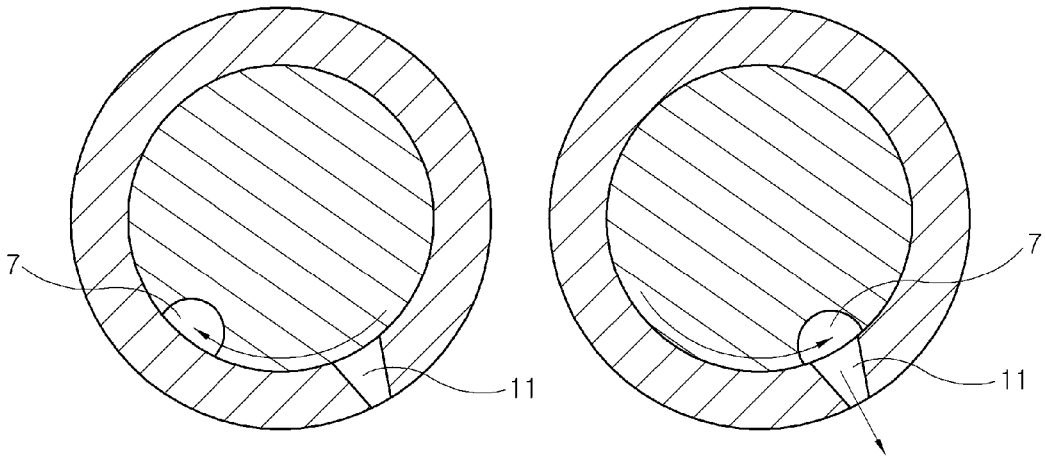
FIG. 7 is a view illustrating the operation of the injector of FIG. 5.

FIGS. 5 to 7 are views showing an exemplary embodiment illustrating the present invention in a different view, in which one fuel groove 7 corresponds to one nozzle hole 11.

In this configuration, rotary rod 5, similar to the exemplary embodiment described above, is rotated by electric motor 3 controlled by the controller, which monitors the operational conditions of the engine on the basis of a variety of information on the engine, in accordance with the operational conditions of the engine, and as shown in FIG. 7, it is controlled such that the amount of communication between fuel groove 7 and nozzle hole 11 becomes different.

That is, the controller accurately controls electric motor 3 such that the amount of communication between fuel groove 7 and nozzle hole 11 becomes different, as described above, such that it is possible to select various types of fuel injection exemplified by the other lines as well as the solid line in FIG. 1.

Therefore, it is possible to variably implement a type of fuel injection that is the most suitable for the operational conditions of the engine, without using a piezo element that is relatively expensive, such that it is possible to improve the fuel efficiency and output of the engine and considerably reduce the harmful exhaust gas.

Obviously, the control described above can also be achieved by controlling the rotational angle of electric motor 3 in another embodiment in which adjacent two nozzle holes 11 are provided for one fuel groove 7. In this configuration, it is possible to improve the operational performance of the engine by controlling whether to make cavitation in fuel injection and injection rate shaping for various types of fuel injection, as described above.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An injector apparatus for an engine, comprising:

an injector body;

an actuator mounted in the injector body;

a rotary rod rotatably received in the injector body and selectively rotated by the actuator, wherein a fuel groove is formed on an outer surface of the rotary rod along a longitudinal direction thereof; and a nozzle hole formed at a nozzle of the injector body to selectively communicate with the fuel groove in accordance with rotation of the rotary rod, wherein the rotary rod slidably contacts with the nozzle in the injector body, wherein a plurality of the nozzle holes is circumferentially disposed on the nozzle in a rotational direction of the rotary rod, wherein two adjacent nozzle holes among the plurality of the nozzle holes have different diameters at an inlet and an outlet respectively, and wherein one of the two adjacent nozzle holes has a diameter larger at the inlet than the outlet thereof, and the other has a diameter smaller at the inlet than the outlet thereof.

2. The injector apparatus for the engine as defined in claim 1, wherein the actuator is a step motor.

3. The injector apparatus for the engine as defined in claim 1, wherein an even number of nozzle holes are provided and one fuel groove of the rotary rod is selectively disposed between the two adjacent nozzle holes.

4. The injector apparatus for the engine as defined in claim 1, wherein injection rate is controlled by operating the actuator while changing a rotational speed and a position thereof.

5. An injector apparatus for an engine, comprising:

an injector body having a nozzle at a lower end thereof, wherein the nozzle includes a nozzle hole;

a step motor installed in the injector body; and a rotary rod selectively rotated by the step motor and having a fuel groove longitudinally formed on an outer surface thereof;

wherein fluid communication of the nozzle hole with the fuel groove is selectively changed by rotation of the rotary rod, wherein a slope is formed at a lower end of the rotary rod, and the nozzle hole is formed at a corresponding portion of the nozzle which is slidably in contact with the slope, wherein a plurality of nozzle holes are formed at the nozzle along a rotational direction of the rotary rod to form an even number of nozzle holes, wherein one fuel groove of the rotary rod is selectively disposed between two adjacent nozzle holes among the even number of the nozzle holes, wherein the two adjacent nozzle holes have a different diameter at an inlet and at an outlet respectively, and wherein one of the two adjacent nozzle holes has a diameter larger at the inlet than the outlet thereof, and the other has a diameter smaller at the inlet than the outlet thereof.

* * * * *